US008310510B2

(12) United States Patent
Asahina

(10) Patent No.: US 8,310,510 B2
(45) Date of Patent: Nov. 13, 2012

(54) PRINTER

(75) Inventor: Shigetoshi Asahina, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 94 days.

(21) Appl. No.: 13/027,384

(22) Filed: Feb. 15, 2011

(65) Prior Publication Data

US 2011/0221854 A1 Sep. 15, 2011

(30) Foreign Application Priority Data

Mar. 9, 2010 (JP) ..... 2010-52170

(51) Int. Cl.
*B41J 3/60* (2006.01)
*B41J 3/62* (2006.01)
*B41J 11/66* (2006.01)

(52) U.S. Cl. ..... 347/171

(58) Field of Classification Search ..... 347/171, 347/213, 110; 400/82, 188, 621, 120.01
See application file for complete search history.

(56) References Cited

U.S. PATENT DOCUMENTS 7,710,442 B2 * 5/2010 Lyons et al. ..... 347/171
7,830,404 B2 * 11/2010 Yamada ..... 347/171
8,194,107 B2 * 6/2012 Lyons et al. ..... 347/171
2007/0212146 A1 * 9/2007 Lyons et al. ..... 400/82
2008/0003039 A1 * 1/2008 Sekino et al. ..... 400/188
2009/0015647 A1 * 1/2009 Rawlings et al. ..... 347/213

FOREIGN PATENT DOCUMENTS

JP 2000-127267 5/2000
JP 2001-071569 3/2001
JP 2001-261226 9/2001
JP 2009-132067 6/2009

* cited by examiner

*Primary Examiner* — Huan Tran

(74) *Attorney, Agent, or Firm* — Turocy & Watson, LLP

(57) ABSTRACT

A printer including a containing unit, first and second heads, a separation member, a cutting member, and a collecting unit. The containing unit is configured to contain a printing medium separable into front and rear surfaces. The first head is configured to print first data on the front surface of the printing medium. The second head is configured to print second data on the rear surface of the printing medium. The separation member is configured to separate the front surface from the printing medium passing through the first and second heads. The cutting member is configured to cut a printed portion of the front surface separated by the separation member. The collecting unit is configured to collect the printing medium of the rear surface remaining after the front surface is separated in order to preserve the rear surface.

20 Claims, 4 Drawing Sheets

PRINTER

CROSS-REFERENCE TO RELATED APPLICATIONS

This application is based upon and claims the benefit of priority from Japanese Patent Application No. 2010-052170, filed on Mar. 9, 2010, the entire contents of which are incorporated herein by reference.

FIELD

Embodiments described herein relate generally to a printer for printing data on a printing medium to issue documents, for example, receipts and journals.

BACKGROUND

In order to keep an accounting of transactions on a computerized-terminal such as a point-of-sale (POS) terminal, a seller may be obligated to issue a receipt bearing printed data related to a product sold to a consumer and to also preserve a journal bearing the same printed data.

A printer for issuing the receipt and the journal may include, for example, a thermal printer utilizing thermal paper having a thermal-sensitive layer formed thereon.

To issue a receipt and a journal using one printer, the printer may have to print data on the receipt and the journal alternatively. Issuance of the receipt and the journal in the manner described above may be time consuming and reduce the printing efficiency.

DETAILED DESCRIPTION

According to one embodiment, a printer includes a containing unit, a first head, a second head, a separation member, a cutting member, and a collecting unit. The containing unit is configured to contain a printing medium having a first surface and a second surface that is detachable from each other. The first head is configured to print first data on the first surface of the printing medium being discharged from the containing unit. The second head is configured to print second data on the second surface of the printing medium being discharged from the containing unit. The separation member is configured to separate the first surface from the printing medium printed by the first and second heads. The cutting member is configured to cut a printed portion of the first surface separated by the separation member. The collecting unit is configured to collect the printing medium of the second surface remaining after the first surface is separated by the separation member.

Figure 1:
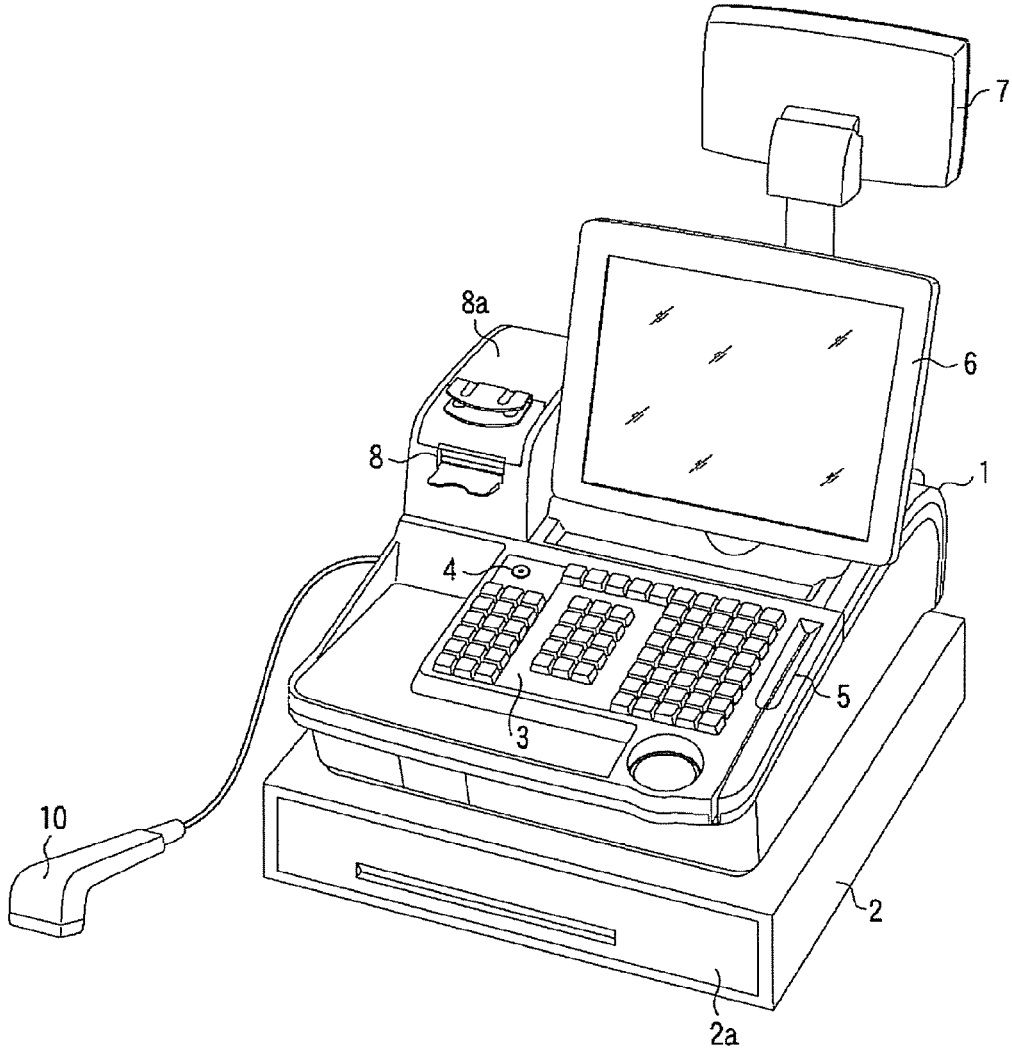
FIG. 1 is a perspective view showing a point-of-sale (POS) terminal according to one embodiment.

Embodiments will now be described in detail with reference to the accompanying drawings. Referring to FIG. 1, there is shown a perspective view showing a product sales data processing apparatus, for example, a point-of-sale (POS) terminal in accordance with one embodiment of the present disclosure. The POS terminal 1 may be arranged on a drawer housing 2 to control the opening and closing of a drawer 2*a* that contains, for example, cash, coins, and checks. The POS terminal 1 includes a keyboard 3, a mode switch 4, a card reader 5, and an operator display 6 on its front side. The POS terminal 1 also includes a customer display 7 on its back side. Further, the POS terminal 1 includes a printer 8 mounted in proximity with the operator display 6. The printer 8 may be configured to print two types of media, for example, a receipt and a journal. A cover 8*a* on an upper side of the printer 8 includes an opening structure that allows a printing medium, e.g., a two-sided thermal paper 30 or a two-sided thermal paper 40, to be loaded into the printer 8. The POS terminal 1 may further include a scanner 10. The scanner 10 optically reads, for example, a bar code or a 2-dimensional code printed on a label attached to a product.

Figure 2:
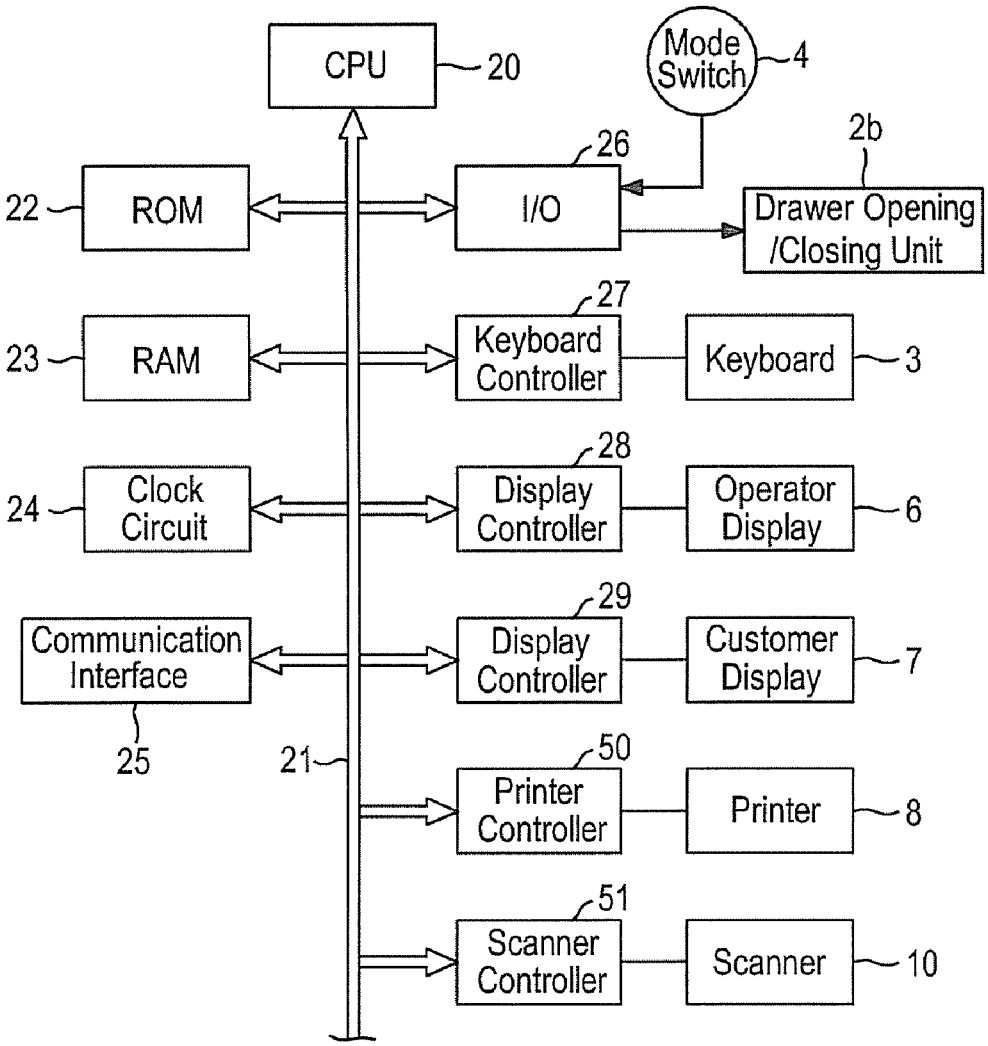
FIG. 2 is a block diagram showing a control unit of the POS terminal.

FIG. 2 shows a block diagram of a control unit of the POS terminal 1 in accordance with one embodiment. As shown in FIG. 2, a central processing unit (CPU) 20 may be connected through a bus line 21 to a read only memory (ROM) 22, a random access memory (RAM) 23, a clock circuit 24, a communication interface 25, an input/output (I/O) port 26, a keyboard controller 27, display controllers 28 and 29, a printer controller 50, and a scanner controller 51.

The ROM 22 stores static data, e.g., programs to be executed by the CPU 20. The RAM 23 may serve as a memory component for storing sales data of products which were registered for sale. For example, the RAM 23 may store a product table, and commercial data and customer service information including color photos or color moving images. In the product table, the registered products may be provided in association with corresponding product data, e.g., product codes and prices. The clock circuit 24 generates a signal indicating current date/timestamp. The communication interface 25 controls data communication with a host apparatus connected through a communication channel, e.g., a local area network (LAN). The I/O port 26 receives a mode selection signal generated from the mode switch 4 and outputs a driving signal for controlling a drawer opening/closing unit 2*b*. The keyboard controller 27 receives key signals upon manipulations of the keyboard 3. The display controller 28 controls the operator display 6. The display controller 29 controls the customer display 7. The printer controller 50 controls the printer 8. The scanner controller 51 controls the scanner 10.

Figure 3:
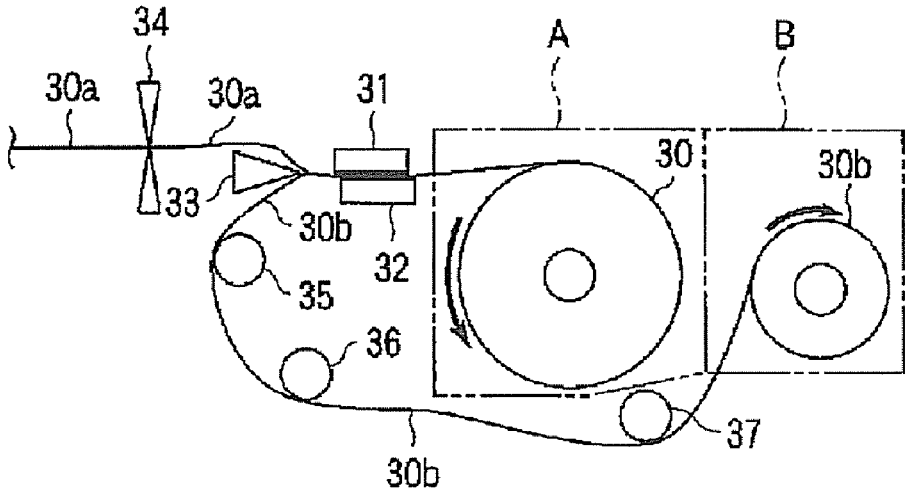
FIG. 3 is a side elevation view showing a printer employed in the POS terminal.

FIG. 3 illustrates a side elevation view of the printer 8 employed in the POS terminal 1 in accordance with the present embodiment.

As shown in FIG. 3, a containing section A of the printer 8 may contain a printing medium, for example, a two-sided thermal paper roll 30 including a front surface and a rear surface that may be detachable from each other. As described above, the cover 8*a* of the printer 8 includes an opening structure that allows the two-sided thermal paper roll 30 to be loaded into or unloaded from the containing section A.

When the two-sided thermal paper roll 30 is loaded into the containing section A, a leading end of the two-sided thermal paper roll 30 may be discharged and conveyed from the containing section A. The two-sided thermal paper roll 30 discharged from the containing section A is then interposed between a first thermal head 31 and a second thermal head 32. The first thermal head 31 and the second thermal head 32 may be vertically arranged to face each other with the two-sided thermal paper roll 30 interposed therebetween. The first thermal head 31 may print first data on a front surface 30*a* of the two-sided thermal paper roll 30. The first data may be print data related to a receipt. The second thermal head 32 may print second data on a rear surface 30*b* of the two-sided thermal paper roll 30. The second data may be print data similar to the first data.

When the printer 8 is in a print ready state, the two-sided thermal paper roll 30 may be in a ready state being interposed between the first and second thermal heads 31 and 32.

When a printing operation is initiated, the leading end of the two-sided thermal paper roll 30 passes through the first and second thermal heads 31 and 32 to reach a separation member 33. The separation member 33 includes an edge having an acute angle (e.g., ranging about 10 to 30 degrees) provided toward the two-sided thermal paper roll 30 being conveyed out of the first and second thermal heads 31 and 32. While the two-sided thermal paper roll 30 is being conveyed toward the separation member 33, the edge of the separation member 33 slides between the front surface 30*a* and the rear surface 30*b* of the two-sided thermal paper roll 30 to separate the front surface 30*a* therefrom.

The front surface 30*a* separated by the separation member 33 then arrives at a cutter 34. The cutter 34 cuts a printed portion of the front surface 30*a*, e.g., a receipt surface, out of the two-sided thermal paper roll 30. Then, the printed portion may be discharged as a receipt.

The rear surface 30*b*, e.g., a journal surface, remaining after separation by the separation member 33 is guided by rollers 35, 36, and 37 toward a collecting section B. The collecting section B may be arranged in proximity with the containing section A. The collecting section B may be configured to wind and collect the rear surface 30*b* as a journal to be preserved.

Figure 4:
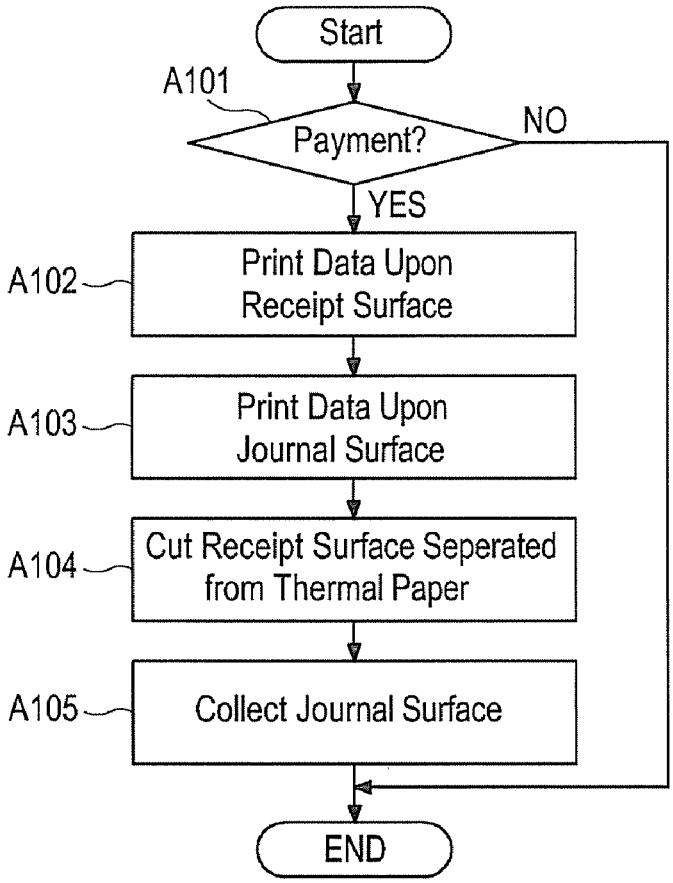
FIG. 4 is a flow chart showing operations of the printer employed in the POS terminal.

With reference to the flow chart shown in FIG. 4, operations of the printer 8 will be described. When payment for a product being sold is made by an operator through the POS terminal 1 (YES of Act A101), the CPU 20 generates print data for a receipt related to the sold product and transmits the print data to the printer controller 50. The printer controller 50 sends the print data to the first thermal head 31 and the second thermal head 32. Then, the first thermal head 31 prints the print data on the first surface 30*a* (e.g., a receipt surface) of the two-sided thermal paper roll 30 (Act A102). Also, the second thermal head 32 prints the print data on the rear surface 30*b* (e.g., a journal surface) of the two-sided thermal paper roll 30 (Act A103).

The leading end of the two-sided thermal paper roll 30 that has been printed at the first and second thermal heads 31 and 32 is conveyed to be in contact with the separation member 33. While the two-sided thermal paper roll 30 is being conveyed toward the separation member 33, the edge of the separation member 33 slides between the front surface 30*a* and the rear surface 30*b* of the two-sided thermal paper roll 30 to separate the front surface 30*a* therefrom.

The printed portion of the separated front surface 30*a* (e.g., the receipt surface) is cut out of the two-sided thermal paper roll 30 (Act A104). The rear surface 30*b* remaining after separation by the separation member 33 is conveyed to the collecting section B to be collected therein as a journal (Act A105).

In this way, the print data for the receipt may be concurrently printed on the front surface 30*a* (e.g., the receipt surface) and the rear surface 30*b* (e.g., the journal surface) of the two-sided thermal paper roll 30. Upon completion of printing the print data, the front surface 30*a* may be separated and cut to be discharged as the receipt while the rear surface 30*b* (e.g., the journal surface) remaining after separation may be collected in the collecting section B. As such, the time required for issuing the receipt and the journal may be reduced. And also, the operator's work efficiency may be improved in manipulating the POS terminal 1 for sales.

As the journal is being wound and collected in the collecting section B, a diameter of the rolled journal may be increased. However, since only the rear surface 30*b* (among the two surfaces of the thermal paper roll 30) is wound and collected in the collecting section B as the journal, the diameter of the rolled journal may be no greater than half the diameter of the two-sided thermal paper roll 30 rolled in the containing section A. For such reason, the space of the collecting section B may be maintained to be reasonably small in the printer 8.

As the printing operation continues, a diameter of the rolled two-sided thermal paper roll 30 in the containing section A (which is provided in proximity with the collecting section B) may progressively decrease. Accordingly, an increment of the rolled journal may be counterbalanced with a reduction of the two-sided thermal paper roll 30. Considering this situation, the collecting section B may be provided to connect to the containing section A by eliminating a partition wall therebetween, which may reduce further the space required for the collecting section B.

In addition, since the first and second thermal heads 31 and 32 print the same print data, an amount of data transmission from the CPU 20 to the printer controller 50 in the POS terminal 1 may decrease. As such, control burdens of the CPU 20 and the printer controller 50 may be reduced, thereby increasing the processing speeds. Consequently, as the processing resources required for printing decreases, the CPU 20 and the printer controller 50 may utilize more resources in other control operations.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus and can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS (Operating System) in the apparatus.

Figure 5:
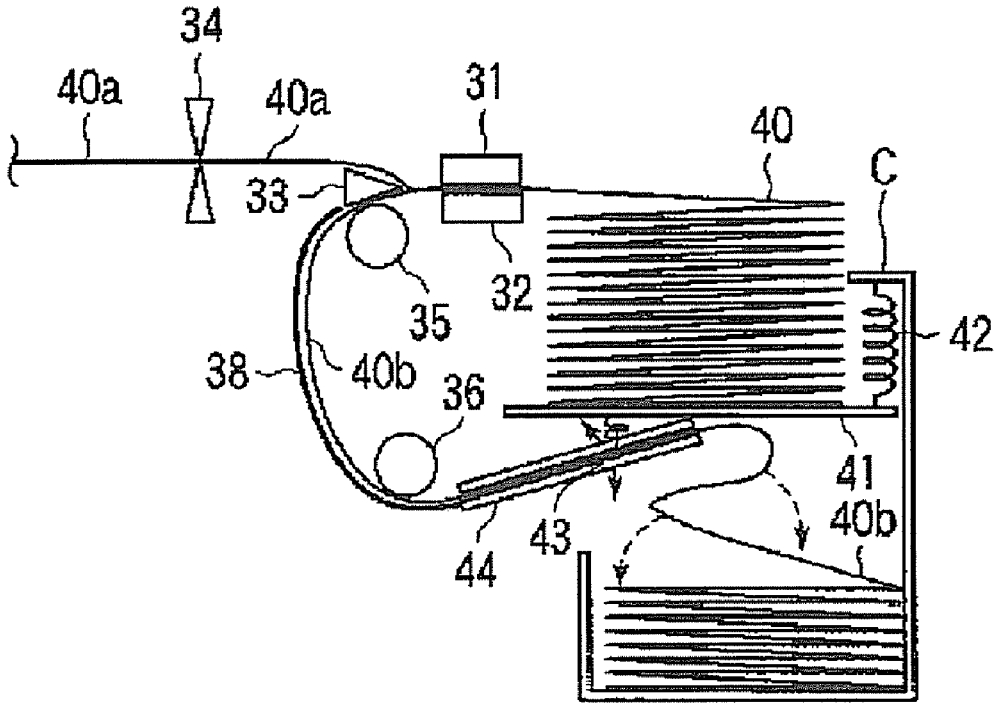
FIG. 5 is a side elevation view showing another illustrative embodiment of the printer employed in the POS terminal.

FIG. 5 shows another illustrative embodiment of the printer 8 in accordance with the present disclosure.

As shown in FIG. 5, a containing/collecting section C may be employed instead of the containing section A and the collecting section B shown in FIG. 3. The containing/collecting section C includes a containing part in an upper space and a collecting part in a lower space. The containing part of the containing/collecting section C may contain a two-sided thermal paper 40 being foldable and stackable in the form of bellows. The two-sided thermal paper 40 has a front surface 40*a* and a rear surface 40*b* that may be detachable from each other. The collecting part of the containing/collecting section C may collect the rear surface 40*b* (e.g., a journal surface)

being foldable and stackable in the form of bellows. The containing part includes a tray 41 to support the two-sided thermal paper 40 and a spring 42 to provide a bias force with respect to an upper side of the tray 41. The collecting part includes an oscillation plate 44 arranged on a lower surface of the tray 41 through a spring 43. The spring 43 provides a bias force with respect to an upper side of the oscillation plate 44. The oscillation plate 44 may be repeatedly pitched upward and downward (as indicated by arrows in FIG. 5) by balancing a weight of the rear surface 40*b* (e.g., the journal surface) being conveyed from a separation member 33 and a tension variation at respective seams formed on the rear surface 40*b*. In this way, the rear surface 40*b* (e.g., the journal surface) is folded and stacked in the collection part in the form of bellows according to a pitching movement of the oscillation plate 44.

The seams may be formed on the two-sided thermal paper 40 at regular intervals along the conveying direction thereof in a transverse direction approximately perpendicular to the conveying direction.

When the printer 8 is in a print ready state, the two-sided thermal paper 40 may be in a ready state being interposed between the first and second thermal heads 31 and 32. When the printing operation is initiated, the leading end of the two-sided thermal paper 40 passes through the first and second thermal heads 31 and 32 to reach the separation member 33. Then, the separation member 33 slides between the front surface 40*a* and the rear surface 40*b* of the two-sided thermal paper 40 to separate the front surface 40*a* therefrom. A printed portion of the separated front surface 40*a* (e.g., a receipt surface) may be cut out of the two-sided thermal paper 40 by a cutter 34 to be discharged.

The rear surface 40*b* (e.g., the journal surface) remaining after separation by the separation member 33 may be guided by rollers 35 and 36 and a guiding member 38 to the oscillation plate 44 of the collecting part. The rear surface 40*b* (e.g., the journal surface) being conveyed to the oscillation plate 44 may be folded in the form of bellows to be stacked in the collecting part as a journal to be preserved.

A height of the journal stacked in the collecting part may be increased as the printing operation continues. However, since only the rear surface 40*b* is collected as the journal in the collecting part, the height of the stacked journal may be half the height of the two-sided thermal paper 40 stacked in the containing part. Therefore, the space of the collecting part required for stacking the journal may be maintained to be reasonably small.

Further, since the height of the two-sided thermal paper 40 stacked in the containing part may progressively decrease as the printing operation continues, the height of the journal stacked in the collecting part may be counterbalanced by the reduction in height of the two-sided thermal paper 40 stacked in the containing part. As such, the space of the collecting part may be maintained to be minimal.

Although in the above embodiments of the present disclosure, the receipt and the journal are described as examples of the two printing media to be issued, the present disclosure may not be limited thereto. For example, a voucher and a coupon may be issued instead of the receipt in accordance with the present disclosure. Also, in accordance with the above embodiments of the present disclosure, the printer 8 is mounted on the POS terminal 1, but the present disclosure may not be limited thereto. For example, the printer 8 may be mounted on any kind of electronic machine to perform the above mentioned operations.

In the above described embodiments, two thermal print heads are employed for printing on a two-sided thermal paper, but the present disclosure may not be limited thereto. For example, in some embodiments, a thermal print head and a platen roller may be used instead of the two thermal print heads (e.g., the first and second thermal heads 31 and 32) for printing on the two-sided thermal paper. In this configuration, while a thermal print head is printing data on one surface of a printing medium with a thermal-sensitive layer formed thereon, the same data may be simultaneously printed on the other surface of the printing medium with another thermal-sensitive layer formed thereon. During this printing operation, the two-sided thermal paper may be tightly interposed between the thermal print head and the platen roller so as to effectively transmit heat generated by the thermal print head from one surface to the other surface thereof and thus print the data on the both sides of the thermal paper, simultaneously.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer, comprising:

a containing unit configured to contain a printing medium having a first surface and a second surface that are detachable from each other;

a first head configured to print first data on the first surface of the printing medium being discharged from the containing unit;

a second head configured to print second data on the second surface of the printing medium being discharged from the containing unit;

a separation member configured to separate the first surface from the printing medium passing through the first and second heads;

a cutting member configured to cut a printed portion of the first surface separated by the separation member; and a collecting unit configured to collect the printing medium of the second surface remaining after the first surface is separated by the separation member to preserve the second surface.

2. The printer of claim 1, wherein the printing medium is a two-sided thermal paper having a thermal-sensitive layer on the first surface and the second surface, and wherein the first head is a first thermal head and the second head is a second thermal head.

3. The printer of claim 1, wherein the printing medium is a two-sided thermal paper having a thermal-sensitive layer on the first surface and the second surface, wherein the first head is a first thermal head and the second head is a second thermal head, and wherein the cutting member cuts the printed portion of the first surface separated by the separation member, and the collecting unit collects the printing medium of the second surface remaining after the first surface is separated to preserve the second surface.

4. The printer of claim 1, wherein the second data is identical to the first data.

5. The printer of claim 1, wherein the first head and the second head face each other with the printing medium being interposed between the first head and the second head.

6. The printer of claim 1, wherein the collecting unit is arranged in proximity with the containing unit.

7. The printer of claim 1, wherein the containing unit and the collecting unit are arranged to be horizontally adjacent to each other.

8. A printer, comprising:

a containing/collecting unit configured to contain a printing medium having a first surface and a second surface that are detachable from each other;

a first head configured to print first data on the first surface of the printing medium being discharged from the containing/collecting unit;

a second head configured to print second data on the second surface of the printing medium being discharged from the containing/collecting unit;

a separation member configured to separate the first surface from the printing medium passing through the first and second heads; and a cutting member configured to cut a printed portion of the first surface separated by the separation member, wherein the printing medium of the second surface remaining after the first surface is separated is collected in the containing/collecting unit.

9. The printer of claim 8, wherein the printing medium is a two-sided thermal paper having a thermal-sensitive layer on the first surface and the second surface that is foldable and stackable in the form of bellows, wherein the first head is a first thermal head and the second head is a second thermal head, wherein the cutting member cuts the printed portion of the first surface separated by the separation member, and wherein the containing/collecting unit collects the printing medium of the second surface remaining after the first surface is separated to preserve the second surface in the form of bellows.

10. The printer of claim 8, wherein the containing/collecting unit includes a containing part configured to contain the printing medium and a collecting part configured to collect the printing medium of the second surface remaining after the first surface is separated.

11. The printer of claim 10, wherein the containing part is arranged in proximity with the collecting part.

12. The printer of claim 11, wherein the containing part and the collecting part are vertically arranged to be adjacent to each other.

13. The printer of claim 10, wherein the containing part includes a tray configured to support the printing medium, and a spring configured to provide a bias force with respect to an upper side of the tray, wherein the collecting part includes an oscillation plate arranged on a lower surface of the tray through a spring, which provides a bias force with respect to an upper side of the oscillation plate.

14. The printer of claim 8, wherein the first head and the second head face each other with the printing medium being interposed between the first head and the second head.

15. A printer, comprising:

a printing unit configured to print data on a printing medium having a first surface and a second surface that are detachable from each other;

a separation member configured to separate the first surface from the printing medium; and a cutting member configured to cut a printed portion of the first surface separated by the separation member, wherein the printing unit prints the data on the first surface and the second surface of the printing medium.

16. The printer of claim 15, wherein the printing unit includes a print head and a printing support member, wherein the printing support member is configured to allow the print head to print the data on the first surface and the second surface, simultaneously.

17. The printer of claim 16, wherein the print head includes a thermal print head and the printing support member includes a platen roller, and the print head and the printing support member face each other with the printing medium being tightly interposed between the print head and the printing support member.

18. The printer of claim 15, further comprising a containing/collecting unit configured to contain the printing medium and collect the printing medium of the second surface after the first surface is separated by the separation member.

19. The printer of claim 15, wherein the printing medium is one of a thermal paper roll and a thermal paper that is foldable and stackable in the form of bellows.

20. The printer of claim 18, wherein the second surface is collected in the form of one of a rolled manner and a bellows manner.

* * * * *